United States Patent [19]

Dürr et al.

[11] Patent Number: 5,026,184

[45] Date of Patent: Jun. 25, 1991

[54] OFFICE MACHINE

[75] Inventors: Heinrich Dürr, Wilnsdorf; Horst Kringe, Netphen; Manfred Rosenthal, Kirchen-Freusburg; Eduard Tercic, Siegen, all of Fed. Rep. of Germany

[73] Assignee: U.S. Philips Corporation, New York, N.Y.

[21] Appl. No.: 321,620

[22] Filed: Mar. 9, 1989

[30] Foreign Application Priority Data

Mar. 10, 1988 [DE] Fed. Rep. of Germany ..... 3807807

[51] Int. Cl.[5] ..... B41J 11/00

[52] U.S. Cl. ..... 400/605; 400/625

[58] Field of Search ..... 400/624, 625, 605, 607, 400/616, 613, 647, 607.2, 608.2, 624, 625, 629, 634, 636, 637, 637.1, 616.1, 616.2, 551; 271/9, 145, 163, 167; 355/308, 309

[56] References Cited

U.S. PATENT DOCUMENTS

| | | | |
|---|---|---|---|
| 4,234,261 | 11/1980 | Hendrischk | 400/605 |
| 4,742,946 | 5/1988 | Hamamichi et al. | 400/616.2 |
| 4,898,488 | 2/1990 | Yokoi et al. | 400/605 |
| 4,925,325 | 5/1990 | Niikawa | 400/605 |
| 4,934,849 | 6/1990 | Yasuoka | 400/551 |
| 4,936,694 | 6/1990 | Yasuoka | 400/605 |
| 4,972,112 | 12/1990 | Yokoi | 400/629 |

FOREIGN PATENT DOCUMENTS

| | | | |
|---|---|---|---|
| 0197340 | 3/1986 | European Pat. Off. . | |
| 0258026 | 8/1987 | European Pat. Off. . | |
| 2203414 | 10/1988 | United Kingdom | 271/9 |

OTHER PUBLICATIONS

IBM Technical Disclosure Bulletin, "Paper Path Switching Mechanism for Automatic Sheet Feeder in a Printer", vol. 28, No. 4, Sep. 1985, pp. 1400–01.

*Primary Examiner*—Edgar S. Burr
*Assistant Examiner*—C. A. Bennett
*Attorney, Agent, or Firm*—William Squire

[57] ABSTRACT

An office machine, for example, a printer, with a printing unit, individual paper transport via driving rollers and endless paper transport via a tractor is to be designed in such a way that as many operating modes as possible can be obtained by simple means. This is achieved at least one releasable cassette for individual paper is in the entry region of a printing unit. A tractor is pivotalby adjustable into a pushing and a pulling position and is located behind the printing unit. The following operating modes are selectable by adjustment of the tractor positions coupled to further components:

a. Straight individual paper transport from the front via driving rollers either by manual infeed or by automatic cassette infeed, the tractor being in the pushing position.
b. Curved endless paper transport from the rear via the tractor set in the pushing position and via a portion of the driving rollers.
c. Straight endless paper transport from the front via the tractor set in the pulling position.

34 Claims, 11 Drawing Sheets

OFFICE MACHINE

Figure 1:
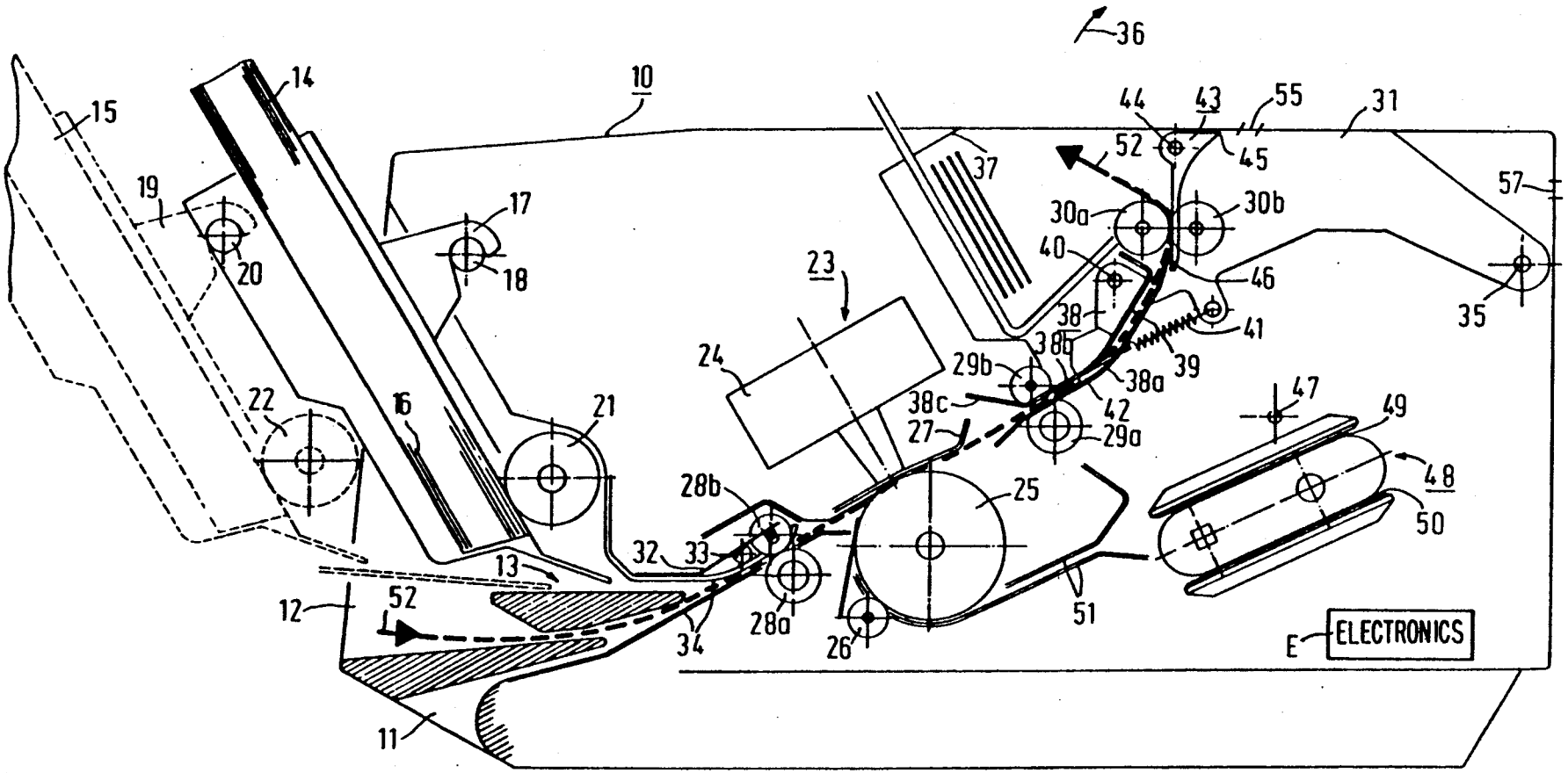

The invention relates to an office machine with a printing unit, individual paper transport via driving rollers and endless paper transport via a pivotable tractor.

Of interest are commonly owned copending applications Ser. No. 487,674 filed Mar. 1, 1990 entitled "Device for Adjustment of a Printer," Ser. No. 317,376 filed Mar. 1, 1989 entitled "Office Machine," and Ser. No. 317,378 entitled "Office Machine" all in the name of M. Rosenthal and Ser. No. 487,677 filed Mar. 1, 1990 in the name of Durr et. al.

An office machine of this type, designed as a printer, became known, for example, from EP 0,197,340 A2. The known printer possesses pairs of rollers arranged in front of and behind the printing unit in the direction of run of the paper and comprising driving and pressure rollers. Furthermore, a tractor located in front of the printing unit and working in the pushing position is provided for the transport of endless paper. The known printer can be changed over from a feed of endless paper to a feed of individual papers by pivoting the tractor. In both operating modes, the path of the paper follows essentially a plane course.

The object on which the invention is based is to design an office machine of the type mentioned in the introduction, in such a way that a plurality of different operating modes can be selected in a simple way at only a little outlay in terms of conversion. This object is achieved because at least one releasable cassette for individual papers is arranged at the front, that is to say in the entry region, and the tractor adjustable into a pushing and a pulling position is located behind the printing unit, and because the following operating modes are selectable as a result of the adjustment of the tractor coupled or coupleable to further components:

a. Straight individual paper transport from the front via driving rollers either by manual infeed or by automatic cassette infeed, the tractor being in the pushing position;

b. Curved endless paper transport from the rear via the tractor set in the pushing position and via driving rollers, c. straight endless paper transport from the front diagonally via the tractor set in the pulling position.

The design according to the invention makes it possible by simple means to obtain changing operating modes on one and the same machine, without functional subassemblies having to be removed or installed. The path of the individual papers fed from the front out of entry channels in the lower region runs essentially in a straight line and diagonally through the housing and terminates in the upper region in a delivery compartment. Endless paper can be fed either from the rear or from the front of the machine. In a feed from the rear, the endless paper runs via the tractor which is in the pushing position, is deflected (curved) by the printing roller and leaves the printer in the upper region. In this operating mode, after the printing unit has been left, the path for the endless paper is initially identical to the path for the individual sheets. The two paths are separated by means of a paper switch located in the upper region of the machine. Depending on the particular position, this paper switch guides the individual papers coming from the front into the delivery compartment and the endless paper coming from the rear through a slit out of the printer housing. When the endless papers are fed from an entry channel in the front region of the printer, the path is essentially straight, but behind the printing unit it is guided towards the paper guide track of the tractor which is in the pulling position, and leaves the printer at a rear housing slit. This paper path is suitable for endless paper which, because of its thickness, should not be curved. As seen from the side, the paper path runs approximately diagonally from bottom left at the front in the entry region to top right in the outlet region of the housing.

By means of the releasable arrangement of the cassettes preferably of identical design, a change-over to automatic individual paper feed can be made in a simple way. The oblique arrangement of the cassettes in the front region allows a clear view and makes handling and refilling easier. The identical design avoids the need for expensive stock-keeping and complicated assembly work. The arrangement of the tractor behind the printing unit allows easy access, for example by swinging up a pivoting housing part. The plurality of different operating modes selectable on one and the same machine is achieved essentially by means of the specially designed, arranged and adjustable tractor which is made coupled or coupleable to further components.

In an embodiment of the invention, a further operating mode selectable is a mixed mode, in which either a curved endless paper transport or, after the endless paper is brought into a parking position of the tractor and held there, straight individual paper transport becomes possible. This operating mode saves laborious repeated threading of the endless paper into the tractor, when a change is to be made from individual paper transport to endless paper transport.

Preferably, the tractor has two stops which act indirectly on the pressure rollers of the pairs of rollers located in front of and behind the printing unit. At the same time, during the pivoting of the tractor into the pulling position, the pressure rollers of the first pair of rollers are releasable as a result of the action of the first stop, whilst the pressure rollers arranged on a pivoting housing part and belonging to the second pair of rollers located behind the printing unit are releasable during the closing of the pivoting housing part by means of the second stop projecting in the pulling position. Swinging up the pivoting housing part arranged pivotably at the top in the rear housing allows ready access to the tractor which is provided with the stops and which, when the pivoting housing part is swung up, can be adjusted into the pulling or pushing position easily and quickly. The stops arranged on the tractor are therefore of decisive importance, and during the swing-up into the pulling position or after the pulling position has been reached these cause a release of the pressure rollers via further components.

In an expedient embodiment, the first stop acts on a lever mechanism with a rod which at its one end, is connected to the pressure rollers of the first pair of rollers via a one-armed rotary lever, in such a way that these pressure rollers are opened or closed during a longitudinal movement, and which, at its other end, is connected in an articulated manner to one lever arm of a two-armed rotary lever, the free lever arm of which has a curved engagement surface for the engagement of the first tractor stop. As a result of the interaction of the first stop with the curved engagement surface of the rotary lever, forces are transmitted reliably and uniformly to the pressure rollers located in front of the printing unit and belonging to the first pair of rollers.

In an embodiment of the invention, the pressure rollers of the second pair of rollers are arranged resiliently on a carrier which, in the pushing position of the tractor, serves as a paper guide unit and which is itself mounted rotatably on the pivoting housing part and which, when the pivoting housing part is opened, is pressed against a projection of the pivoting housing part via a tension spring. The arrangement of the pressure rollers and of the paper guide unit on the pivoting part in the first place allows easy access to the tractor when the pivoting arm is swung up. The rotatable arrangement of the carrier serves for disengaging the pressure rollers arranged on the carrier from the associated driving rollers when the pivoting housing part is swung down. This is achieved because, when the pivoting housing part is closed and the tractor is brought into the pulling position, the carrier together with the pressure rollers is deflected counter to the force of the tension spring by the second stop of the tractor, so that the pressure rollers are lifted and the paper!guide unit is moved out of the paper track for endless paper transport in the pulling mode. The tractor swung up in the pulling position thus makes it possible to open the pressure rollers reliably via the projecting second stop. Furthermore, with the tractor brought into the pulling position, the paper track can thereby be changed in a simple way.

In an embodiment of the invention, when the tractor is in a pushing position, the straight paths for individual papers and the curved path for endless papers follow an identical course through the paper guide unit behind the printing unit, and, for deflecting the paper paths there is provided behind the paper guide unit a switch, which is rotatable in the pivoting housing part. This switch can be coupled to a tractor drive via a two-armed rotary lever mounted rotatably in the housing, in such a way that, whenever the tractor drive is connected or disconnected as a result of a rotational movement of the rotary lever, a simultaneous adjustment of the switch takes place. Such a positive coupling between the switch, on the one hand, and the tractor, on the other hand, ensures that, when the tractor drive is disconnected, individual paper transport via driving rollers becomes possible and, as a result of a corresponding position of the switch, the individual papers are deposited in a delivery device. By contrast, when the tractor drive is connected, the endless paper transport is set in motion, and at the same time the switch which is designed as a tear-off edge in the rear part and which is then adjusted causes the endless papers to be guided out of the printer through a special housing slit.

This takes place in a simple way preferably because the rotary lever has two lockable positions, in a first lever position the tractor being driven for endless paper transport and the switch being set at endless paper delivery, and in a second lever position the tractor being disconnected and the switch being adjusted to individual paper delivery. A connection between the switch and the rotary lever which can easily be made is advantageously obtained if one lever arm of the rotary lever is operatively connected in an articulated manner to the free end of a shackle which is coupled firmly to a rotary axle of a switch. Because the shackle engages by means of a peg projecting at right angles into a fork-shaped recess formed at the end of the lever arm, an especially robust construction not liable to faults is obtained.

The actuation of the tractor drive preferably takes place because the other lever arm of the rotary lever carries a driving roller which is driven by a main drive of the office machine and which, during the rotation of the rotary lever, can be brought into or out of engagement with a driving wheel of the tractor. This type of connection and disconnection of the tractor drive is of simple design and not liable to faults.

The two-armed rotary lever can be moved in various ways. In a preferred embodiment, the rotary lever is adjustable via a motor-driven eccentric which acts on one of the two lever arms. This preferably takes place because one of the lever arms has a clearance, into which the eccentric penetrates with a fit. Depending on the type of machine, manual actuation can also be advantageous, and the two-armed rotary lever can be equipped with an additional hand lever. Finally, the rotary lever can also be adjusted as a result of a horizontal movement of a printer slide.

Exemplary embodiments of the subject according to the invention are illustrated diagrammatically in FIGS. 1 to 11 of the drawing and, together with further advantages, are explained in the following description.

FIGS. 1 to 6 each show a side view of a printer in different operating modes for different types of paper with different papers paths illustrated.

Figure 2:
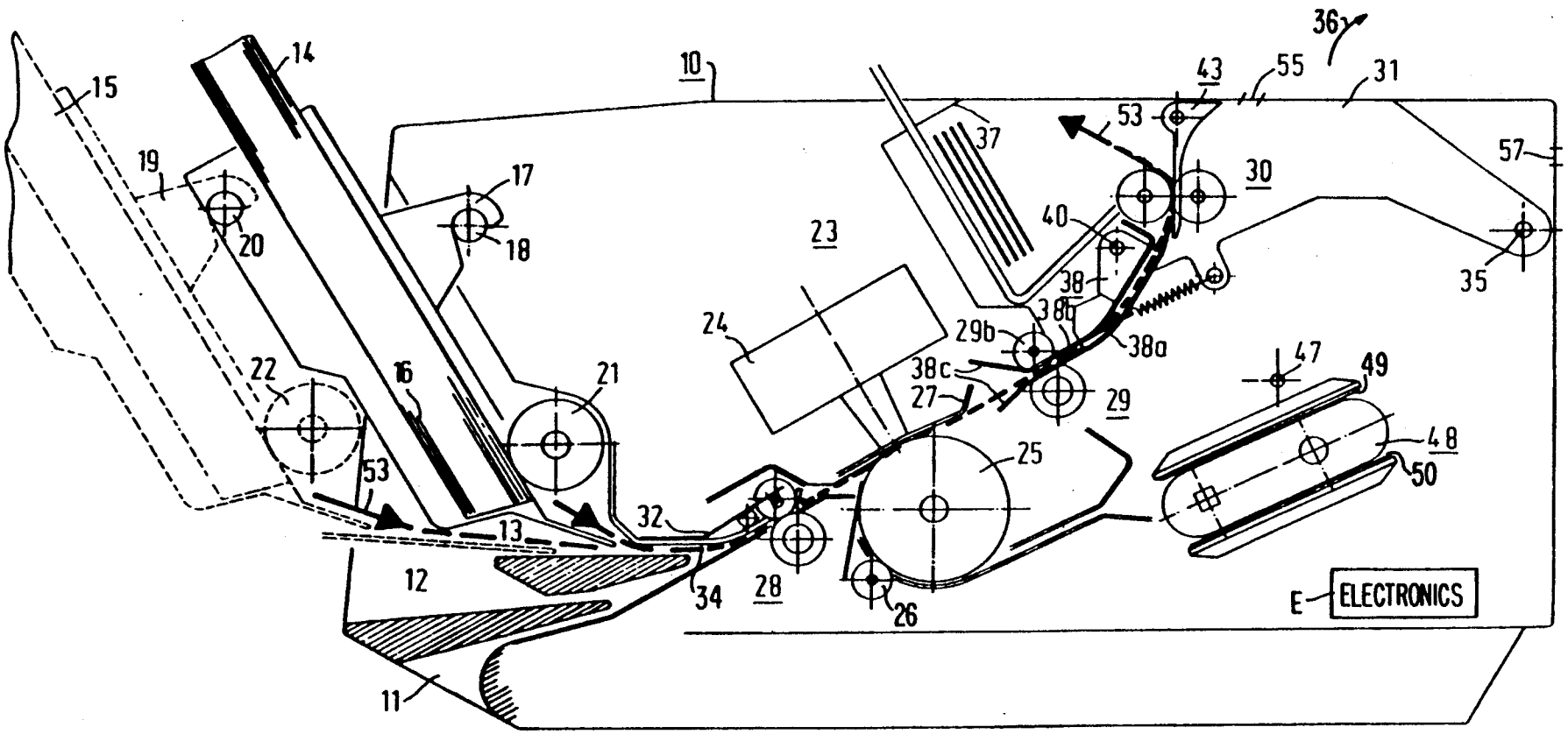
Figure 3:
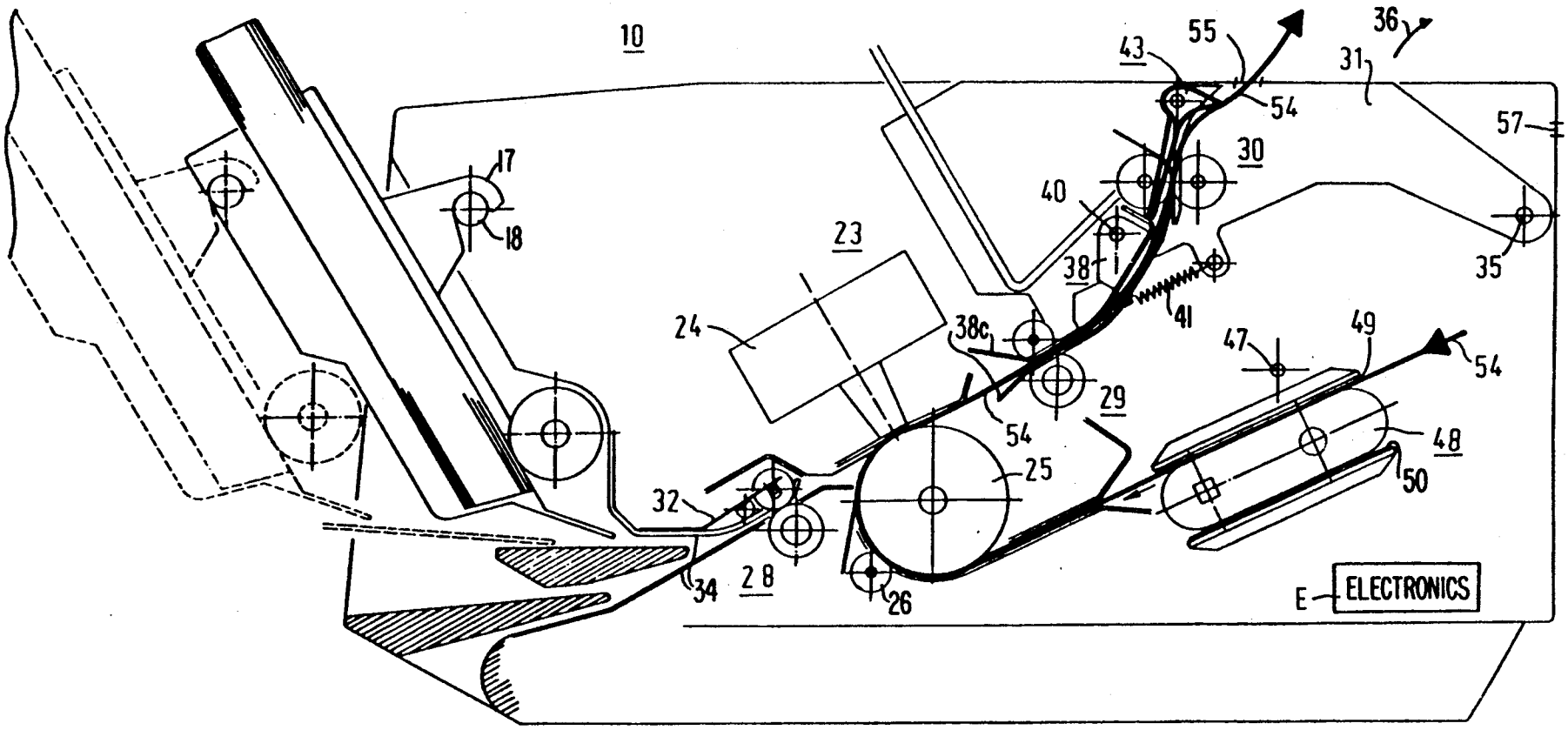
Figure 4:
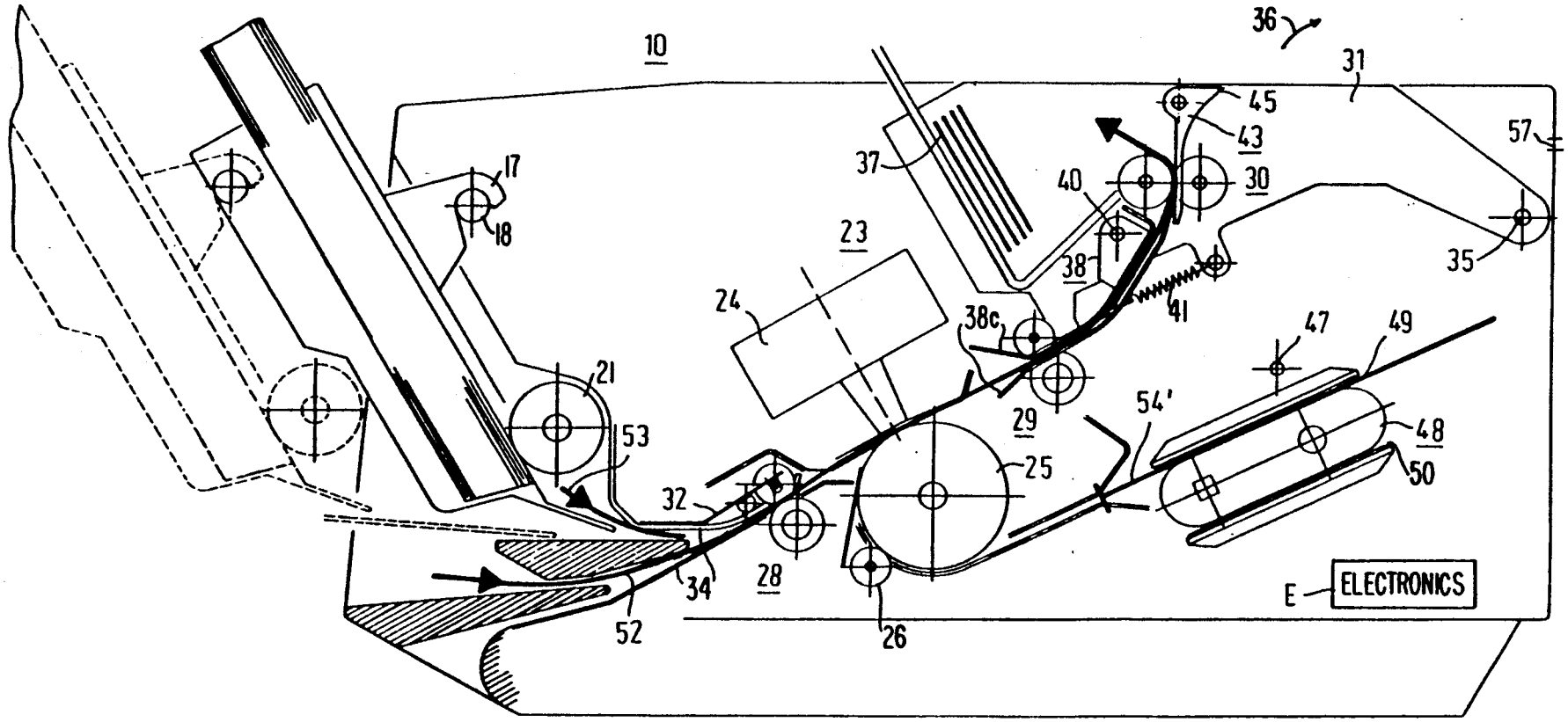
Figure 5:
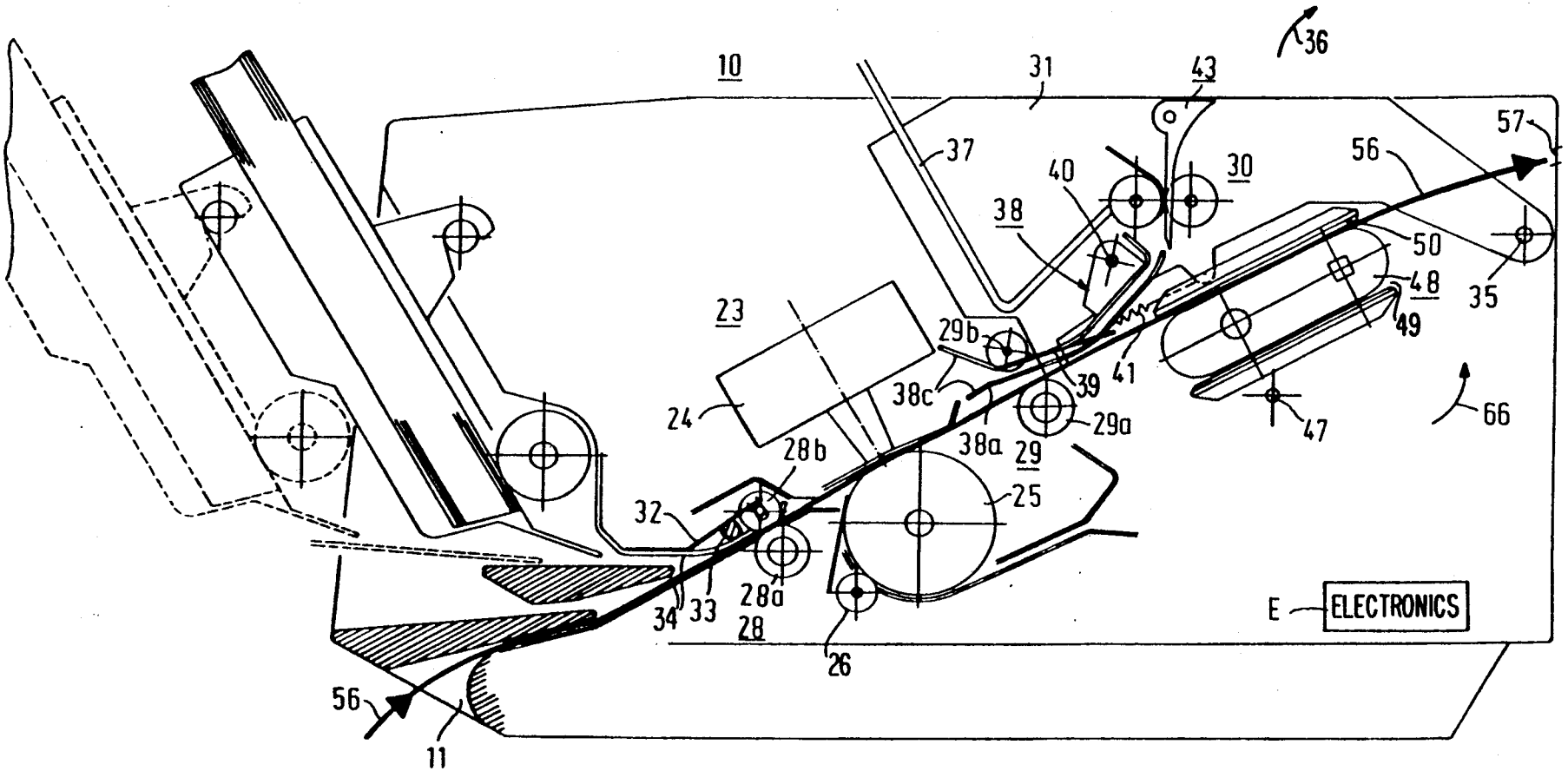
Figure 6:
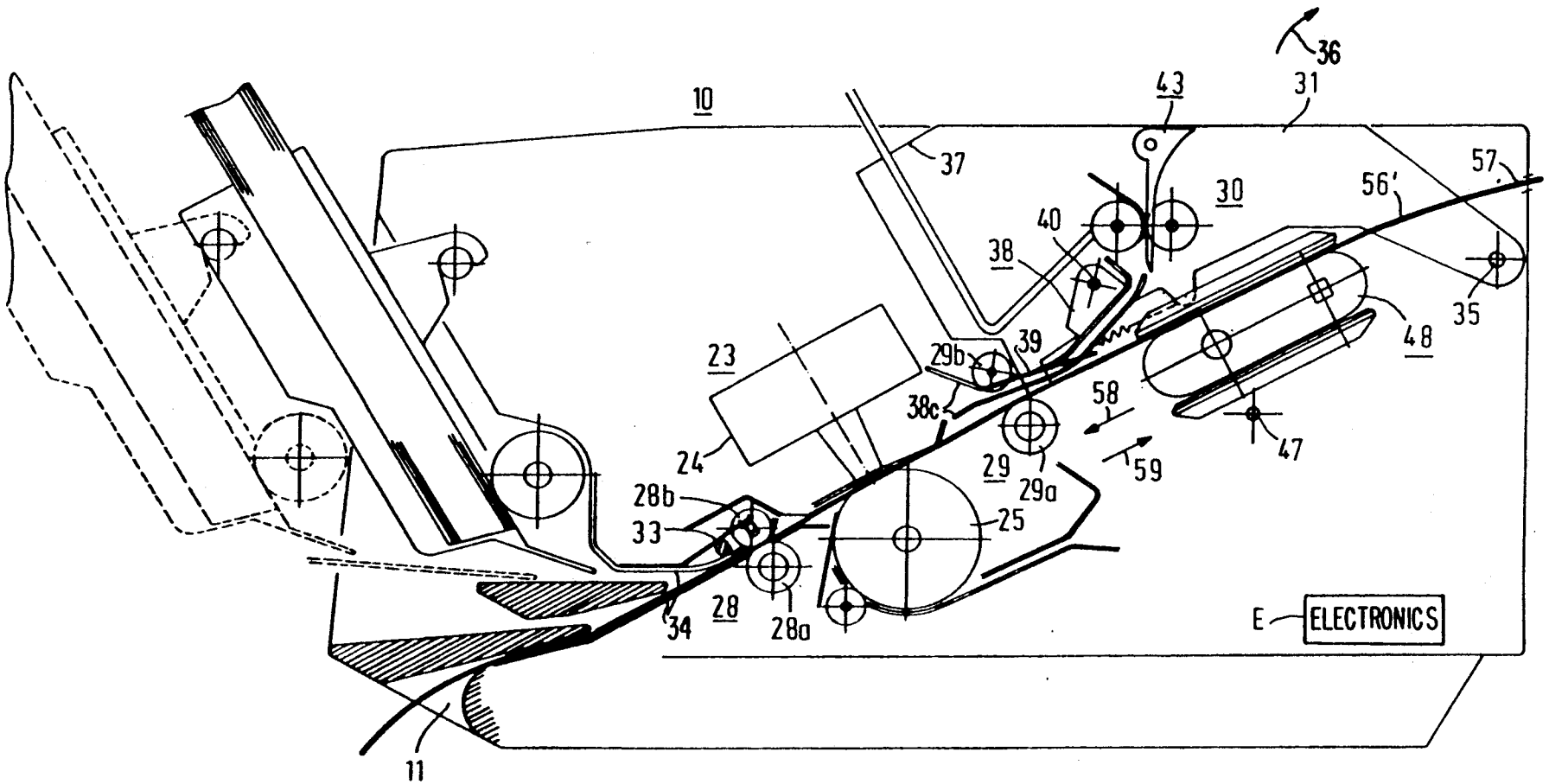
Figure 7:
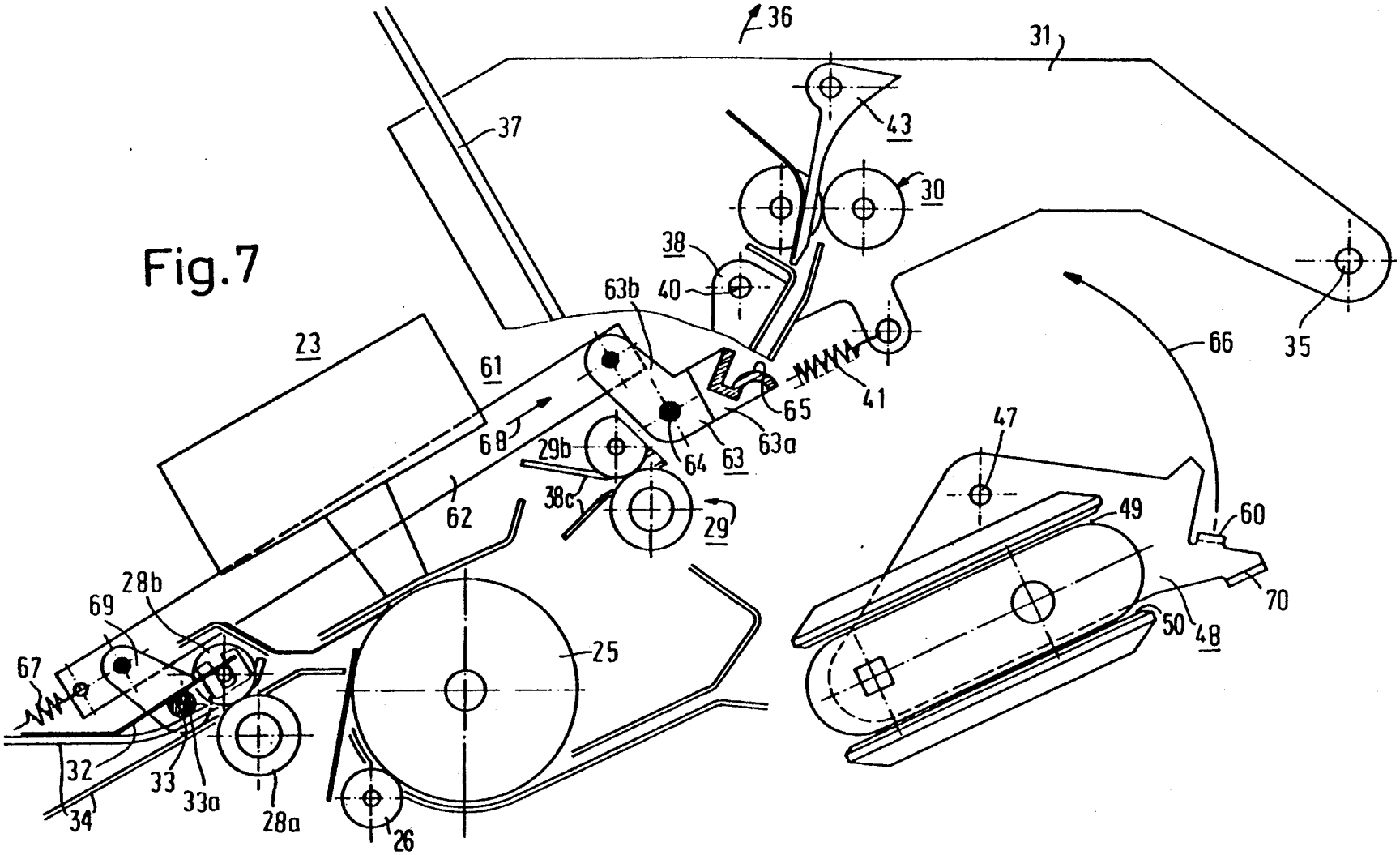
Figure 8:
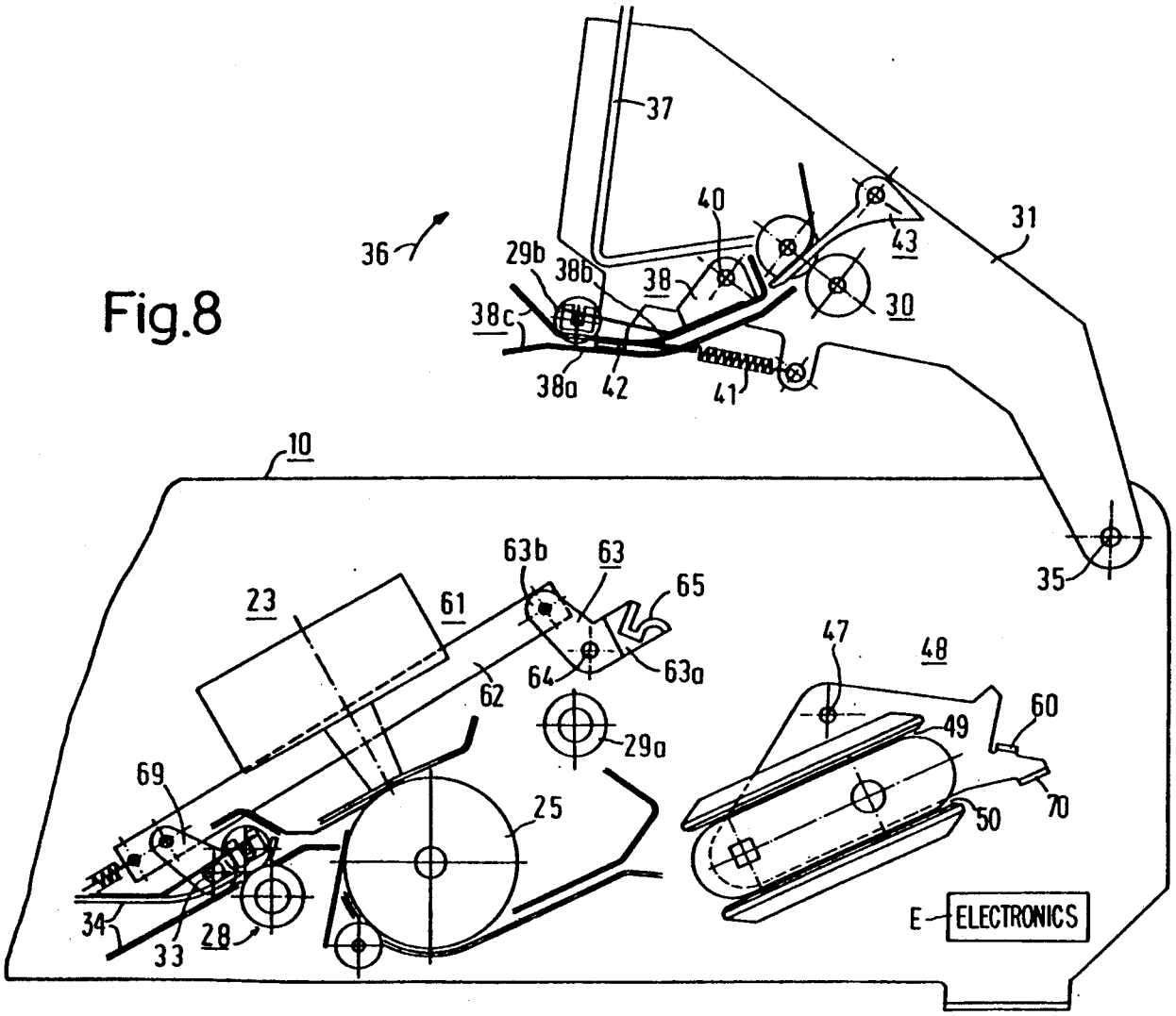
Figure 9:
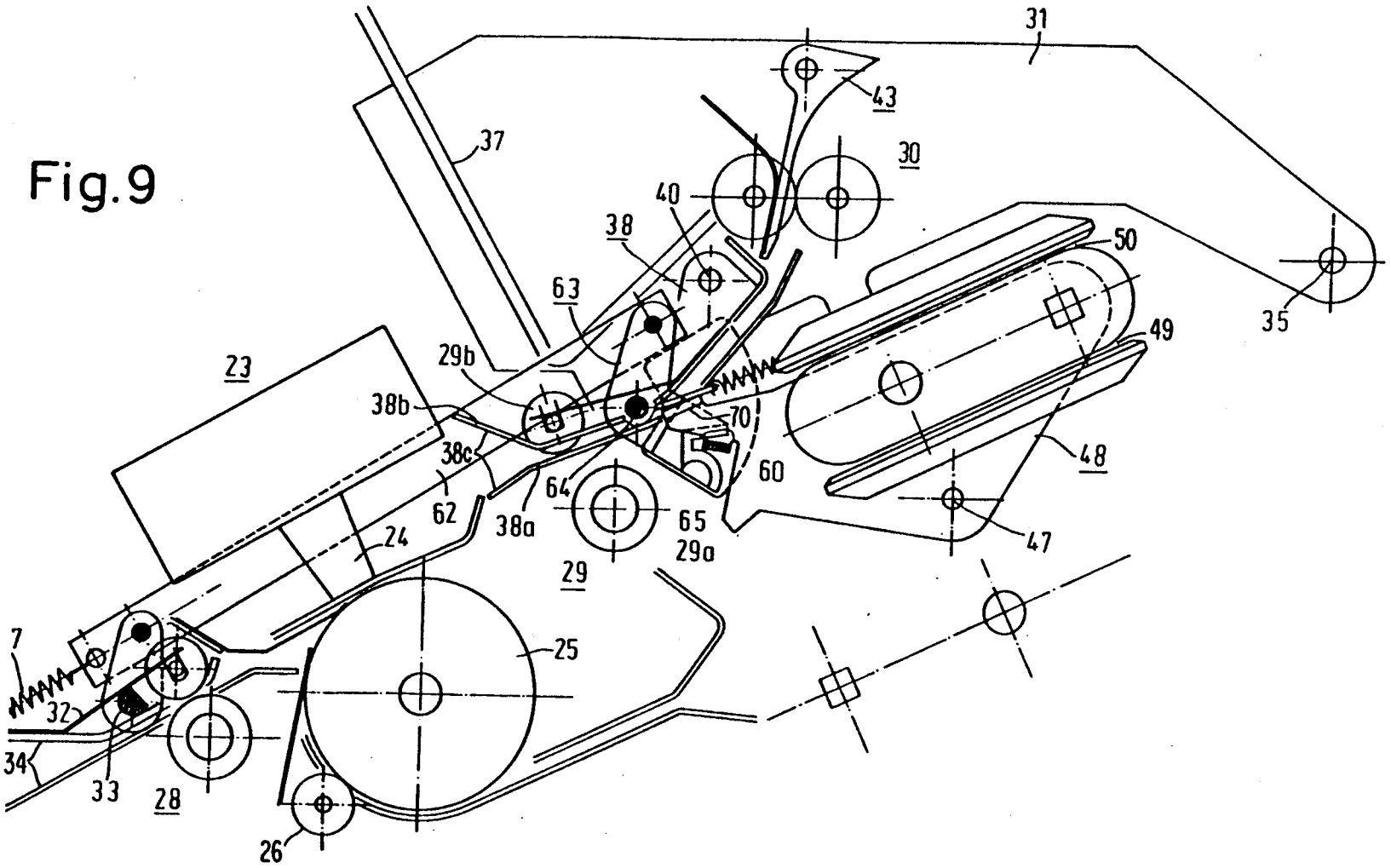
Figure 10:
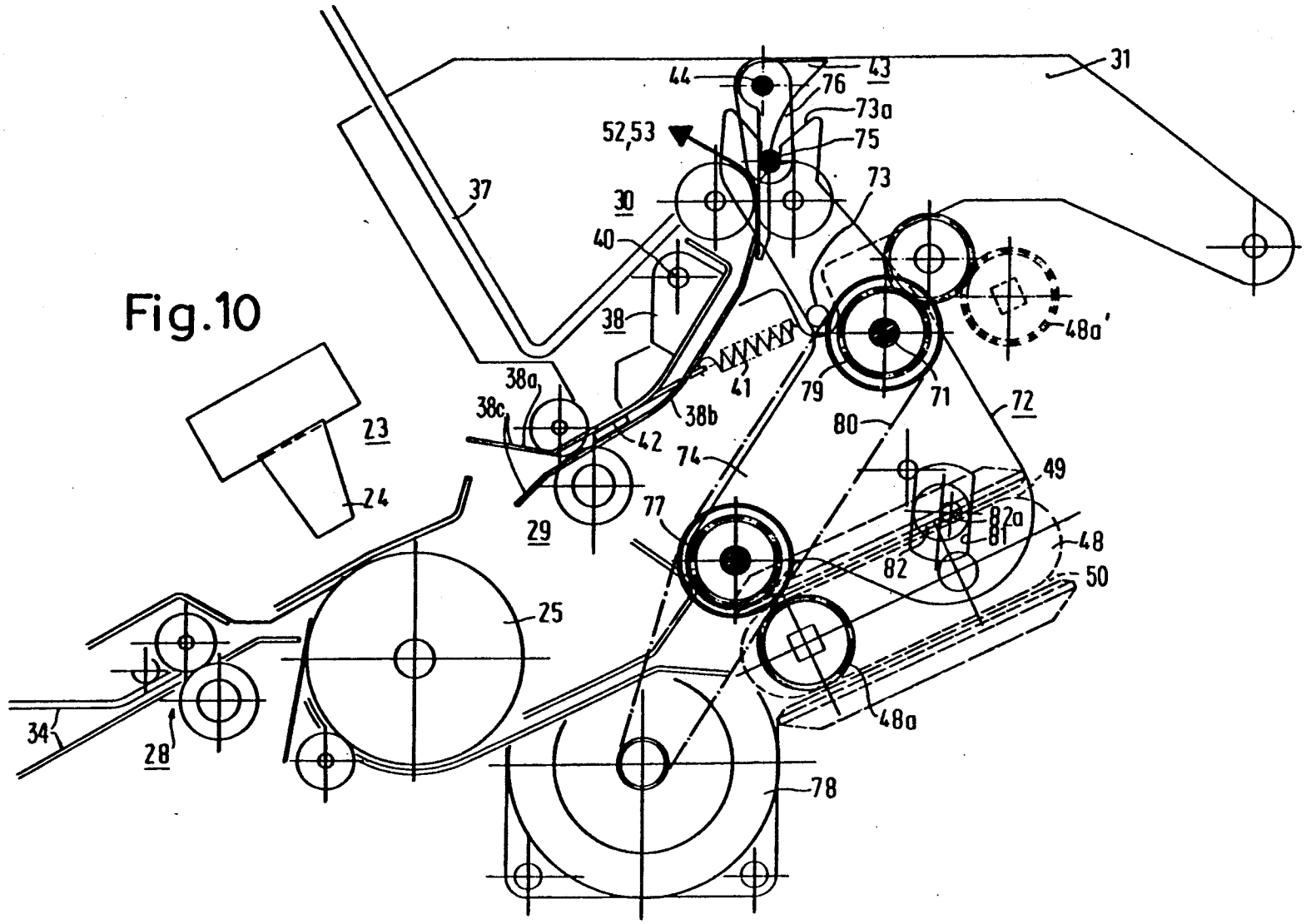
Figure 11:
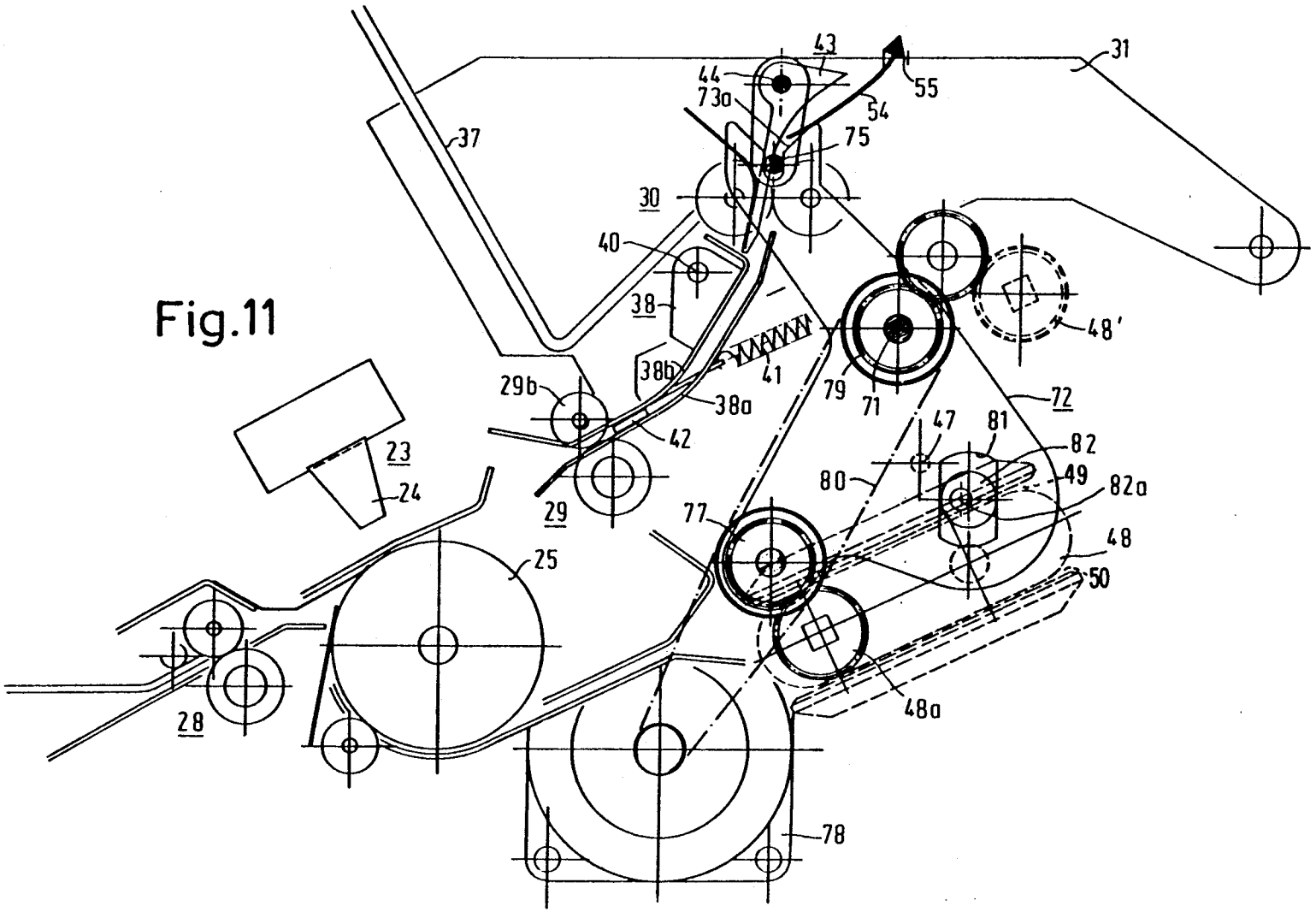

FIG. 1 shows the paper path for manual infeed of individual sheets from the front, with the individual sheets being delivered in the delivery compartment in the upper region, FIG. 2 shows the paper path for an automatic infeed of individual sheets from cassettes at the front, with the individual sheets being delivered in the delivery compartment, FIG. 3 shows the paper path of endless papers for an infeed from the rear, with the endless papers being deflected and with an outlet in the upper region, FIG. 4 shows a mixed mode with the paper paths according to FIGS. 1 and 2 for individual sheets, the endless papers according to FIG. 3 remaining in a parking position within the printer, FIG. 5 shows the non-curved paper path for endless papers for an infeed from the front with an outlet in the rear region of the printer, FIG. 6 shows the non-curved paper path for endless papers for an infeed from the rear with an outlet for the endless papers in the front region, FIG. 7 shows a diagrammatic partial side view with a tractor in the pushing position, FIG. 8 shows the partial side view according to FIG. 7 with a pivoting housing part swung up, FIG. 9 shows a diagrammatic partial side view with a tractor in the pulling position, FIG. 10 shows a diagrammatic partial side view with a paper switch in individual paper transport position according to FIGS. 1 and 2, and FIG. 11 shows a diagrammatic partial side view with a paper switch in the endless paper transport position according to FIG. 3.

The printer according to FIGS. 1 to 6 includes a housing 10 which is closed essentially on all sides in the operating state. On the front side of the printer (left side of the figure) there are channels 11, 12 and 13 for the paper transport. Cassettes 14 and 15 supply individual sheets 16 which, as described further below, are fed to a printing apparatus via the channel 13. The first cassette 14 is suspended on pins 18 (one being shown) of the housing 10 via hooks 17 (one being shown), whilst the second cassette 15 of identical design is suspended on pins 20 (one being shown) of the first cassette 14 via hooks 19 (one being shown). Separating rollers 21 and 22 are connected to the respective cassettes 14, 15. Depending on the prevailing conditions of space, several cassettes of this type can be arranged against one another by the piggyback method.

The printing apparatus 23 is arranged centrally within the housing 10 and contains, as a printing unit, a matrix printer 24 with a printing roller 25 and pressure roller 26. The paper to be printed is guided through between a printing roller 25 and the guide plate 27. Three pairs of rollers 28*a, b*, 29*a, b* and 30, *b* guide the paper. The rollers 28*a*, 29*a* and 30*a* are driving rollers and the rollers 28*b*, 29*b* and 30*b* are pressure rollers. The associated drives for the driving rollers 28*a* to 30*a* are not shown. The driving rollers 28*a* and 29*a* are mounted rotatably at a fixed location in sidewalls of the housing 10, and the driving rollers 30*a* are mounted in a pivoting housing part 31. In the exemplary embodiments according to FIGS. 1 to 4, the pressure rollers 28*b* likewise mounted in sidewalls of the housing 10 are pressed against the driving rollers 28*a* by a leaf spring 32. In the exemplary embodiments according to FIGS. 5 and 6, the leaf spring 32 is lifted as a result of the rotation of a shaft 33 of D-shaped cross-section, so that the pressure rollers 28*b* are no longer pressed against the driving rollers 28*a* under the spring force. Furthermore, a paper guide unit 38 together with the pressure rollers 29*b* are also lifted. Entry guide plates are designated by 34.

The pivoting part 31 is mounted rotation about axle 35 in the housing 10 and can be pivoted upwards in the direction of the arrow 36 from the operating positions shown in FIGS. 1 to 6. The pivoting part 31 also contains a delivery compartment 37 for receiving the individual sheets. A paper guide unit 38 extends over the width of the housing and has two wings 38*a*, 38*b* forming a slit 39 and, at the start, widened to form an opening mouth 38*c*. The paper guide unit 38 is mounted rotatably at pivot 40 in the pivoting part 31 and, in the operating states according to FIGS. 1 to 4, is pressed against a projection 42 of the pivoting part 31 by a spring 41. The pairs of rollers 28*a*, 28*b*, 29*a* 29*b*, and 30i a,30*b* each comprise individual rollers extending over the width of the housing 10. The individual rollers 29*a*, 29*b* pass through the wings 38*a,b* at corresponding openings in the wings and, in the exemplary embodiments according to FIGS. 1 to 4, rest against one another under spring pressure. A paper path switch which is mounted rotatably on the pivoting part 31 at pivot 44 and which switch has a tear-off edge 45 and parts 46 projecting between the individual rollers 30i a,30 *b*. Switch 43 can be adjusted by control means into a position on the right, as shown in FIGS. 1 and 2, for example, or into a position on the left, as in FIGS. 3 and 7, for example.

A tractor 48 pivotable via pins 47 (one being shown) in walls of the housing 10 is provided underneath the pivoting part 31. In FIG. 1, the tractor 48 is locked in a first end position (pushing position) and, by being pivoted about the pins 47, can be adjusted into a second end position according to FIGS. 5 and 6 (pulling mode) and locked in position. The tractor 48 possesses two paper guide tracks 49, 50 for the transport of endless paper. Guide plates 51 are provided between the tractor 48 and the printing roller 25.

The driving rollers are actuated in the conventional way by drive means (not shown), for example drive motors. The individual functional cycles are controlled by means of electronics E not explained in detail here.

During the manual infeed of individual sheets of paper according to FIG. 1, the paper infeed takes place in the channel 12. Driving and pressure rollers 28*a*,28 *b*, 29*a*,29*b* and 30i a,30*b* are pressed against one another. The tractor 48 is inoperative. The individual sheets pushed into the channel 12 are transported along the path 52 and delivered to the delivery compartment 37. The path switch 43 is adjusted to the right position.

According to FIG. 2, individual sheets of paper 16 are fed automatically from the cassettes 14, 15 to the channel 13. In this case, the corresponding drives 21, 22 are then activated by means of the electronics E, the channel 12 being blocked by sensors (not shown). Otherwise, the components assume the same positions as in the exemplary embodiment according to FIG. 1, so that in this case the path 53 is essentially identical to the path 52 according to FIG. 1. Here too, the tractor 48 is inoperative. The arrangement of the cassettes in the front tending region and their oblique position relative to the tending plane make handling and refilling easier and make it possible to have a clear view of the operating situation. One, two or more cassettes can be attached as required. In principle, the feed of individual sheets in the channel 12 is not impeded by the arrangement of the cassettes.

FIG. 3 shows the same printer with endless paper being fed into the paper guide track 49 of the tractor 48 from the rear. In this exemplary embodiment, the tractor 48 is put into operation and the path switch 43 is set to the left. The pairs of rollers 28*a*,28*b*, 29*a*,29*b* and 30i a,30*b* assume the same operating position as in FIGS. 1 and 2. The endless paper runs along the paper path 54 and leaves the printer housing at an outlet 55. The activation of the tractor 48 and the adjustment of the switch 43 take place in a single operation: see further below with reference to FIGS. 9 and 10.

FIG. 4 illustrates a mixed mode comprising the operating modes according to FIGS. 1 to 3. Starting from the setting according to FIG. 3, a printed endless paper is severed at the tear-off edge 45; the end of the endless paper still located in the machine is then moved back in reverse through the tractor 48 as a result of a control command, until the end has still just not yet left the paper guide track 49. The drive of the path tractor 48 is then switched off, and at the same time the switch 43 is adjusted to the right position (see, in this respect, the description of FIGS. 9 and 10). The path is then free again for feeding individual papers along the path 52 according to FIG. 1 or path 53 according to FIG. 2. In this mixed mode, therefore, during the feeding of individual papers along the paths 52, 53 the endless paper remains in the machine in a so-called parking position 54' according to FIG. 4. There is therefore no need for the endless paper to be fed into the tractor 48 again when the operating mode is changed. Only simple control commands are sufficient for this purpose.

For feeding the endless paper into the tractor 48 according to FIGS. 3 or 4, the pivoting part 31 is swung up about the axle 35, so that the tractor 48 is freely accessible for tending purposes.

The operating state illustrated in FIG. 5 relates to a feed of endless paper through the channel 11 from the front. To adopt this operating state, the pivoting part 31 is swung up, so that the now exposed tractor 48 can be pivoted about the pins 47 in the direction 66 from its pushing position according to FIGS. 1 to 4 into the pulling position according to FIG. 5 and locked in place. In this operating mode, the endless paper introduced into the channel 11 is essentially to be pulled outwards through the tractor 48 on a substantially straight track past the printing unit 24, as indicated by the paper path 56. The endless paper leaves the printer at an exit 57. Here, the tractor 48 works in the so-called pulling position via the paper guide track 50 (and in this mode is not to be impeded by the pairs of rollers 28*a*,28*b* and 29*a*,29*b*.) This is ensured because the pressure roller 28*b* is been disengaged from the driving roller 28*a* as a result of a lifting of the spring 32. The pressure roller 29*b* is disengaged from roller 29*a*. The paper can therefore run through to the printer 24, without being impeded. Furthermore, the paper guide unit 38 together with the pressure roller 29*b* is lifted, so that the endless paper runs past underneath the wing 38*a* and is not intercepted by the mouth 38*c*. The endless paper is consequently pulled by the tractor 48 only. The uncoupling of the pressure rollers 28*b*, 29*b* which is described further below with reference to FIGS. 7 to 9 is necessary because the corresponding driving rollers 28*a*, 29*b* usually rotate somewhat faster than the tractor, so that, when the rollers are closed, paper bulges could possibly occur.

FIG. 6 illustrates a further operating mode in which the individual parts assume the position according to FIG. 5. The tractor 48 is in the pulling position. The endless paper 56' is fed through the exit 57 from the rear and introduced into the tractor 48. This now transports the endless paper, with the foot of the form to be printed in front, towards the channel 11 in the direction 58. At the same time, the form head (the top of the printed matter) of the first form to be printed is moved into the printing position under the control of sensors (not shown). During the printing of this form, the paper moves in the direction 59 opposite direction 58. After the end of printing, the form is ejected out of the channel 11 in the direction 58, specifically until the form head of the second form is in the printing position. The first form is now completely out of the channel 11 and can be severed. The printing and transport of the second form in the direction 59 can take place immediately thereafter. After the second form has been printed, the return transport out of the channel 11 in the direction 58 takes place as described above. By means of the operation just described, the form last printed can be severed immediately without any form being lost.

FIGS. 7 to 9 show how the pressure rollers 28*b*, 29*b* are released from their driving rollers 28*a*, 29*a*, when the tractor 48 is pivoted out of its pushing position, for example according to FIG. 3, into its pulling position according to FIGS. 5 or 6. To release the pressure rollers 28*a*, 29*b*, the pivoting part 31 is first swung up in the direction 36, thus allowing access to the tractor 48.

According to FIGS. 7 and 8, the pressure rollers 28*b* are released because, during the swing-up of the tractor 48 from its pushing position to its pulling position, a first stop 60 of the tractor 48 acts on the pressure roller 28*b* via a lever mechanism 61. For this purpose, a rod 62 is connected in an articulated manner at one end to a two-armed rotary part 63 which is mounted in the housing via shaft 64 and which, on the free lever arm 63*a*, has a curved engagement surface 65 for the engagement of the stop 60. During the pivoting of the tractor 48 in the direction 66, the stop 60 comes into engagement with the free end 63*a* of the rotary part 63 and slides on the engagement surface 65. The rod 62 is thereby deflected in the direction 68 counter to the force of a spring 67 and at the same time rotates a one-armed lever 69 which is connected fixedly in terms of relative rotation to the flattened shaft 33. As a result of the rotation of the lever 69, the leaf spring 32 is lifted, so that the pressure roller 28*b* is released.

As a result of the adjustment of the tractor 48 into its pulling position according to FIG. 9, a second stop 70 attached to the tractor 48 has been brought into the path of movement of the pivoting part 31. During the downswing of the pivoting part 31, the paper guide unit 38 arranged rotatably on port 31, together with the pressure roller 29*b* fastened thereto, stops 70 and are lifted by stop 70 relative to their position in FIG. 1. The pressure roller 29*b* is thereby released from the driving roller 29*a*. This also at the same time opens the way for the transport of the endless paper, since the paper guide unit 38 is pivoted out of the path of the endless paper as a result of the rotational movement.

A simple design of the tractor 48 with two suitably required in the pushing position of the tractor can be released simply by swinging the tractor up into the pulling position. At the same time, therefore, a paper guide device can be moved out of the region of the paper run in the pulling mode. The release of the pressure rollers on the one hand, and, if appropriate, the change of the paper path therefore take place automatically as a result of the adjustment of the tractor, without any additional components having to be added or removed. This is achieved solely as a result of a clever and carefully planned interaction between the stops of the tractor on the one hand and the pressure rollers on the other hand.

FIGS. 10 and 11 show how a change-over from individual paper transport from the front with a relatively straight paper path (FIGS. 1 and 2) to endless paper transport from the rear with a curved paper path 54 (FIG. 3) can be obtained by adjusting the switch 43, the tractor remaining in the pushing position. For this purpose, a two-armed rotary lever 72 is mounted rotatably at a center of rotation 71 in the sidewalls of the housing and has a first lever arm 73 and a second lever arm 74. The first lever arm 73 is connected, via a fork-shaped clearance 73*a*, to a peg 75 of a shackle 76 which is connected fixedly in terms of relative rotation to the path switch 43. The second lever arm 74 carries a driving roller 77 which, together with a further driving roller 79 mounted for rotation about axis 71, is driven by a main drive 78 via a toothed belt 80. The rotary lever 72 has a slotted opened 81, into which an eccentric 82 penetrates.

When the eccentric 82 is in the position shown in FIG. 10, the rotary lever 72 is consequently pivoted about the axis 71 in the clockwise direction, so that the driving rollers 77 is disengaged from the driving wheel 48*a* of the tractor 48. This therefore cannot convey any endless paper. As a result of the rotational movement of the rotary lever 72, at the same time the path switch 43 is moved to the right about axis 44 via the fork-shaped end 73*a* of the lever arm 73, so that the individual papers travel along the paths 52, 53 past the switch 43 on the left into the compartment 37.

To change over from individual paper transport (FIGS. 1, 2) to endless paper transport (FIG. 3), in FIG. 10 the eccentric 82 is rotated through 180° about its axis of rotation 82*a* and assumes the position shown in FIGS. 11. The rotary lever 72 is thereby moved in the counter-clockwise direction and brings the driving roller 77 into engagement with the driving roller 48*a* of the tractor 48. At the same time, the switch 43 is moved to the left via the peg 75, so that the path 54 for the endless paper transport now leads past the switch 43 on the right and leaves the housing through a slit 55. A broken line 48' represents the driving roller of the tractor 48 when the latter, after rotating about an axis defined by pins 47, is engaged in its second swung-up position (pulling position). During this change-over, the paper guide unit 38 has not been adjusted.

We claim:

1. An office printing machine having a plurality of operating modes comprising:

a printing unit having a paper entry region and at least one paper exit region;

a plurality of drive rollers secured to the printing unit for transporting individual paper for printing by the printing unit, a first of said rollers being in front of said printing unit between the unit and said entry region;

a tractor pivotally secured to the printing unit behind the printing unit for transporting endless paper for printing by the printing unit, said tractor being adjustable into pushing and pulling positions;

means coupled to the printing unit for releasably receiving at least one paper cassette for individual paper at said entry region; and means including means responsive to the position of said tractor for selecting an operating mode of the office machine comprising:

a. first means including at least a portion of said plurality of rollers for providing a first approximately straight paper transport path from the entry region for said individual paper from a first infeed path at said entry region for manual feeding of said individual paper and a second infeed path for automatic feeding of said individual paper while said tractor is in said pushing position;

b. second means for providing a second curved endless paper transport path from said at least one exit region via a portion of said plurality of rollers and said tractor while said tractor is in said pushing position; and c. third means for providing a third approximately straight paper path from said entry region through said tractor while the tractor is in said pulling position.

2. The office machine of claim 1 including fourth means for providing a mixed mode in which are included for parking endless paper in said tractor while enabling said first means for feeding said individual paper.

3. The office machine of claim 2 wherein said tractor includes first and second stops, said first of said rollers including a first pair of rollers having a pressure roller, said plurality of rollers including a second pair of rollers behind the printing unit and having a pressure roller, said printing unit including a pivotable housing part having open and closed states, the pressure roller of the second pair of rollers being secured to said housing part, said unit including means responsive to said first stop for selectively releasing the pressure roller of the first pair according to the pivot position of said tractor, said housing part in the closed state being responsive to the pivot position of said tractor for selectively releasing said pressure roller of the second pair in accordance with the pivot position of said tractor.

4. The office machine of claim 2 wherein the first means for providing a first approximately straight path for individual paper and the second mean for providing a curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the device for operating the tractor in accordance with the lever rotary position, in such a way that, whenever the tractor drive is connected or disconnected as a result of a rotational movement of the rotary lever, a simultaneous adjustment of the path switch takes place.

5. The office machine of claim 3 wherein the first means for providing a first approximately straight path for individual paper and the second means providing a curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the drive for operating the tractor in accordance with the lever rotary position, in such a way that, whenever the tractor drive is connected or disconnected as a result of a rotational movement of the rotary lever, a simultaneous adjustment of the path switch takes place.

6. The office machine of claim 2 wherein said means for releasably receiving said at least one cassette includes at least one peg for each cassette.

7. The office machine of claim 6 wherein said tractor includes first and second stops, said first of said rollers including a first pair of rollers having a pressure roller, said plurality of rollers including a second pair of rollers behind the printing unit and having a pressure roller, said printing unit including a pivotable housing part having open and closed states, the pressure roller of the second pair of rollers being secured to said housing part, said unit including means responsive to said first stop for selectively releasing the pressure roller of the first pair according to the pivot position of said tractor, said housing part in the closed state being responsive to the pivot position of said tractor for selectively releasing said pressure roller of the second pair in accordance with the pivot position of said tractor.

8. The office machine according to claim 6 wherein the first means for providing a first approximately straight path for individual paper and the second mean for providing a curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the drive for operating the tractor in accordance with the lever rotary position, in such a way that, whenever the tractor drive is connected or disconnected as a result of a rotational movement of the rotary lever, a simultaneous adjustment of the path switch takes place.

9. The office machine of claim 6 further including at least one cassette, said at least one cassette including at least one hook mating with said at least one peg, said at least one hook and peg being oriented such that the at least one cassette is secured obliquely relative to a horizontal plane normal to the force of gravity.

10. The office machine of claim 9 wherein said tractor includes first and second stops, said first of said rollers including a first pair of rollers having a pressure roller, said plurality of rollers including a second pair of rollers behind the printing unit and having a pressure roller, said printing unit including a pivotable housing part having open and closed states, the pressure roller of the second pair of rollers being secured to said housing part, said unit including means responsive to said first stop for selectively releasing the pressure roller of the first pair according to the pivot position of said tractor, said housing part in the closed state being responsive to the pivot position of said tractor for selectively releasing said pressure roller of the second pair in accordance with the pivot position of said tractor.

11. The office machine of claim 9 wherein the first means for providing a first approximately straight path for individual paper and the second mean for providing a curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the device for operating the tractor in accordance with the lever rotary position, in such a way that, whenever the tractor drive is connected or disconnected as a result of a rotational movement of the rotary lever, a simultaneous adjustment of the path switch takes place.

12. The office machine of claim 9 including a plurality of said cassettes, each of said plurality of cassettes including said at least one hook and said at least one peg, a first of said plurality of cassettes being coupled to said at least one peg, the remaining of said plurality of cassettes being coupled in cascaded order to said first cassette by coupling of a hook of a following cassette to the peg of a preceding cassette.

13. The office machine of claim 1 including means for forming (1) a first channel at said entry region for manual feed of said individual paper, (2) a second channel at said entry region for automatic feed of said individual paper from said at least one cassette and (3) a third entry channel for endless paper, said entry channels is being positioned one above the other.

14. The office machine of claim 13 wherein said tractor includes first and second stops, said first of said rollers including a first pair of rollers having a pressure roller, said plurality of rollers including a second pair of rollers behind the printing unit and having a pressure roller, said printing unit including a pivotable housing part having open and closed states, the pressure roller of the second pair of rollers being secured to said housing part, said unit including means responsive to said first stop for selectively releasing the pressure roller of the first pair according to the pivot position of said tractor, said housing part in the closed state being responsive to the pivot position of said tractor for selectively releasing said pressure roller of the second pair in accordance with the pivot position of said tractor.

15. The office machine according to claim 13 wherein the first means for providing a first approximately straight path for individual paper and the second mean for providing a curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the device for operating the tractor in accordance with the lever rotary position, in such a way that, whenever the tractor drive is connected or disconnected as a result of a rotational movement of the rotary lever, a simultaneous adjustment of the path switch takes place.

16. The office machine of claim 1 wherein the first means for providing a first approximately straight path for individual paper and the second mean for providing a curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the drive for operating the tractor in accordance with the tractor drive is connected or disconnected as a result of a rotational movement of the rotary lever, a simultaneous adjustment of the path switch takes place.

17. The office machine of claim 16 wherein the first means for providing a first approximately straight path for individual paper and the second mean for providing a curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the drive for operating the tractor in accordance with the lever rotary position, in such a way that, whenever the tractor drive is connected or disconnected as a result of a rotational movement of the rotary lever, a simultaneous adjustment of the path switch takes place.

18. The office machine of claim 1 wherein said tractor includes first and second stops, said first of said rollers including a first pair of rollers having a pressure roller, said plurality of rollers including a second pair of rollers behind the printing unit and having a pressure roller, said printing unit including a pivotable housing part having open and closed states, the pressure roller of the second pair of rollers being secured to said housing part, said unit including means responsive to said first stop for selectively releasing the pressure roller of the first pair according to the pivot position of said tractor, said housing part in the closed state being responsive to the pivot position of said tractor for selectively releasing said pressure roller of the second pair in accordance with the pivot position of said tractor.

19. The office machine according to claim 18 including a carrier secured to said housing part, the pressure roller of the second pair of rollers is resiliently secured on said carrier which, in the pushing position of the tractor, forms a paper guide unit and which carrier is mounted rotatably on the pivoting housing part and which, when the pivoting housing part is opened, is pressed against a projection of the pivoting housing part via a tension spring.

20. The office machine according to claim 19, wherein when the pivoting housing part is closed, in the pulling position of the tractor, the carrier together with the pressure roller of the second pair of rollers is deflected counter to the force of said tension spring by said second tractor stop, so that the latter pressure roller is released and the carrier is moved out of the paper path for endless paper transport in the tractor pulling position.

21. The office machine according to claim 10 wherein the pressure roller of the second pair of rollers is mounted resiliently on the upper wing of the paper guide unit to the carrier.

22. The office machine according to claim 18 wherein the first means for providing a first approximately a second straight path for individual paper and the second mean for providing a second curved path for endless papers include means such that said latter paths follow an identical course in a portion of the path behind the printing unit, a drive coupled to said tractor and a paper path switch for deflecting paper, which switch is rotatably secured to the pivoting housing part and which is coupled to said tractor drive via a two-armed rotary lever for selectively coupling the drive for operating the tractor in accordance with the lever rotary position, in such a way that, whenever the tractor drive is connected or disconnected as a result of a rotational movement of the rotary lever, a simultaneous adjustment of the path switch takes place.

23. The office machine according to claim 22 wherein the rotary lever has two lockable positions, in that, in a first lever position, the machine includes means for driving the tractor in the pushing position for endless paper transport and for setting the switch at endless paper transport, and in that, in a second lever position, the tractor drive is disconnected, the pairs of rollers are driven for individual paper transport and the path switch is adjusted for individual sheet delivery.

24. The office machine according to claim 23 including a switch axle and a shackle coupled to said switch axle wherein one lever arm of the rotary lever is operatively connected in an articulated manner to an end of the shackle which is coupled firmly to said rotary axle of the switch.

25. The office machine according to claim 24 wherein the lever one arm has a forked-shaped recess at an end thereof, the shackle engages by means of a peg projecting the right angles to the shackle into the fork-shaped recess formed at the end of the lever arm.

26. The office machine according to claim 22 wherein the other lever arm of said lever carries a driving roller which, during the rotation of the rotary lever, can be brought into or out of engagement with the driving wheel of the tractor.

27. The office machine according to claim 22 wherein the two-armed rotary lever is adjustable via an eccentric which acts on one of the lever arms.

28. The office machine according to claim 27 wherein one of the lever arms has an opening into which the eccentric penetrates and cooperates.

29. The office machine according to claim 28 wherein the switch includes a projection serving as a tear-off edge.

30. The office machine according to claim 29 wherein the region of the tear-off edge, the office machine includes a housing having an outlet slit for endless paper.

31. The office machine according to claim 21 wherein, in the region located opposite the tear-off edge of the switch, the housing has a delivery compartment for individual sheets.

32. The office machine of claim 18 wherein said means responsive to the first stop includes a lever mechanism comprising a one-arm and a two-arm rotary lever and a rod connected at one end to the one arm lever and at its other end in an articulated joint to one lever arm of the two-armed lever, the one-arm lever being coupled to the first pair of rollers such that the pressure roller of the first pair is selectively released in accordance with the rotary position of said two-arm lever, the other arm of the two-arm lever including a stop engagement surface for engaging said first stop when the tractor is in said pulling position to place the two-arm lever in said release position.

33. The office machine according to claim 32 wherein the one-armed rotary lever includes a rotary shaft having a fattened portion and a circular circumference portion, against which periphery a blade spring rests under pressure, said blade spring acts on the mounting of the latter pressure roller in such a way, that pressure roller is released when the blade spring rests against the circular circumference portion of the rotary shaft and is pressed down against the other roller of that pair when it rests against the flattened portion.

34. The office machine according to claim 32 including a spring coupled to said mechanism such that during the engagement of the first stop with the engagement surface, the rod of the lever mechanism is deflected counter to the force of said spring.

* * * * *